US010988278B2

(12) United States Patent
Zhou et al.

(10) Patent No.: US 10,988,278 B2
(45) Date of Patent: Apr. 27, 2021

(54) PACKAGING STRUCTURE

(71) Applicant: Zhejiang Sanhua Intelligent Controls Co., Ltd., Zhejiang (CN)

(72) Inventors: Haoyu Zhou, Zhejiang (CN); Xianrang Wei, Zhejiang (CN)

(73) Assignee: Zhejiang Sanhua Intelligent Controls Co., Ltd., Zhejiang (CN)

( * ) Notice: Subject to any disclaimer, the term of this patent is extended or adjusted under 35 U.S.C. 154(b) by 0 days.

(21) Appl. No.: 16/477,142

(22) PCT Filed: Jan. 17, 2018

(86) PCT No.: PCT/CN2018/073000
§ 371 (c)(1),
(2) Date: Jul. 10, 2019

(87) PCT Pub. No.: WO2018/133794
PCT Pub. Date: Jul. 26, 2018

(65) Prior Publication Data

US 2019/0352040 A1 Nov. 21, 2019

(30) Foreign Application Priority Data

Jan. 20, 2017 (CN) ..... 201710049665.5

(51) Int. Cl.
*B65D 1/36* (2006.01)
*B65D 75/36* (2006.01)
*B65D 85/42* (2006.01)

(52) U.S. Cl.
CPC ..... *B65D 1/36* (2013.01); *B65D 75/368* (2013.01); *B65D 85/42* (2013.01)

(58) Field of Classification Search
CPC ..... B65D 1/36; B65D 75/368; B65D 85/42
(Continued)

(56) References Cited

U.S. PATENT DOCUMENTS 4,852,738 A * 8/1989 Craig ..... A61C 19/02 206/369
5,344,021 A * 9/1994 Rose ..... B65D 21/045 206/505

(Continued)

FOREIGN PATENT DOCUMENTS

CN 102530343 A 7/2012
CN 202358392 U 8/2012

(Continued)

OTHER PUBLICATIONS

International Search Report and Written Opinion for International Application No. PCT/CN2018/073000, dated Apr. 19, 2018.

(Continued)

*Primary Examiner* — Jacob K Ackun
(74) *Attorney, Agent, or Firm* — Wolf, Greenfield & Sacks, P.C.

(57) ABSTRACT

A packaging structure for electronic expansion valves includes a body for accommodating the electronic expansion valves, wherein the body includes more than one supporting portion, each supporting portion has first recess portions and second recess portions alternately arranged, the first recess portions and the second recess portions are all configured to support housings of the electronic expansion valves; and a center distance of each of the first recess portions and the adjacent second recess portion is the same as an outer diameter of the housing of each of the electronic expansion valves, to allow the housings of two of the electronic expansion valves to be attached together after the two electronic expansion valves are placed in an opposite direction.

13 Claims, 8 Drawing Sheets

(58) Field of Classification Search
USPC ..... 206/443, 587, 564, 486, 419, 422, 701, 206/725, 726, 728
See application file for complete search history.

(56) References Cited

U.S. PATENT DOCUMENTS

| | | | | | |
|---|---|---|---|---|---|
| 5,377,855 | A * | 1/1995 | Cook, Jr. | B65D 75/24 | 220/4.23 |
| 5,474,178 | A * | 12/1995 | DiViesti | H01R 43/00 | 206/564 |
| 5,794,796 | A * | 8/1998 | Weisburn | G11B 33/0461 | 206/307.1 |
| 6,705,469 | B2 * | 3/2004 | Slot | B65D 81/133 | 206/587 |
| 7,886,908 | B2 * | 2/2011 | Farrar | B65D 1/34 | 206/370 |
| 8,556,229 | B2 * | 10/2013 | Lv | F25B 41/062 | 251/129.11 |
| 2014/0374414 | A1 | 12/2014 | Lanier et al. | | |
| 2016/0136352 | A1 * | 5/2016 | Smith | B65D 1/36 | 206/366 |

FOREIGN PATENT DOCUMENTS

| | | | |
|---|---|---|---|
| CN | 104555078 | A | 4/2015 |
| CN | 104960758 | A | 10/2015 |
| CN | 205169093 | U | 4/2016 |
| JP | 2003-276790 | A | 10/2003 |
| JP | 2014-528785 | A | 10/2014 |
| JP | 3201210 | U | 11/2015 |

OTHER PUBLICATIONS

Office Action for Korean Application No. 10-2019-7021862, dated Sep. 7, 2020.

Office Action for Japanese Application No. 2019-534798, dated Oct. 6, 2020.

Extended European Search Report for European Application No. 18741415.6, dated Oct. 12, 2020.

* cited by examiner

PACKAGING STRUCTURE

This Application is a national stage filing under 35 U.S.C. 371 of International Patent Application Serial No. PCT/CN2018/073000, filed Jan. 17, 2018, which claims priority to Chinese patent application No. 201710049665.5 titled "PACKAGING STRUCTURE", filed with the China National Intellectual Property Administration on Jan. 20, 2017. The entire contents of these applications are incorporated herein by reference in their entireties.

FIELD

The present application relates to the field of product packaging technology, and in particular to a packaging structure for electronic expansion valves.

BACKGROUND

Referring to FIG. 1, FIG. 1 is a schematic view showing the structure of a typical electronic expansion valve in the conventional technology.

As shown in FIG. 1, the electronic expansion valve 100 has an outer shape of a substantial T-shape, and includes a valve body 101, a housing 105 provided on the valve body 101, and a first connecting pipe 102 and a second connecting pipe 103 connected to the valve body 101. A magnetic rotor 104 is provided in the housing 105. The valve body 101, the housing 105, the magnetic rotor 104 and the first connecting pipe 102 are coaxially provided, and the second connecting pipe 103 is connected to a side surface of the valve body 101, and is arranged substantially perpendicular to an axis of the valve body 101.

In addition to the above structure, the second connecting pipe of a part of the electronic expansion valves 100 is configured as a bent structure, where the axis of a part of the pipe section is still perpendicular to the axis of the valve body 101, and another part of the bent pipe section is substantially parallel to the first connecting pipe 102.

Generally, when the electronic expansion valve 100 is shipped from the factory, an opening degree of the valve is adjusted to a specified position and the valve does not need to be re-opened and reset during subsequent assembly process, which requires that the packaging structure of the electronic expansion valve 100 can properly position the valve to avoid the change of the opening degree of the valve due to vibration during transportation.

In conjunction with FIG. 2, FIG. 2 is a schematic view showing a packaging structure of an electronic expansion valve in the conventional technology.

As shown in FIG. 2, the packaging structure is a dustproof cap member 200 having at least two connected dustproof caps 201. When packaging, the electronic expansion valves 100 of the same number as the dustproof caps 201 are placed in the same direction and side by side; the adjacent two electronic expansion valves 100 are attached together by the magnetic rotors 104 in the housings 105, and the dustproof caps 201 of the dustproof cap member 200 are sequentially covered on the connecting pipes of the electronic expansion valves 100 to fix the electronic expansion valves 100. Each of the electronic expansion valves 100 has two connecting pipes, so each set of electronic expansion valves 100 is packaged and fixed by two dustproof cap members 200 during packaging; in encasement, each set of the fixed electronic expansion valves 100 is placed in a respective compartment of a packaging box.

Although this packaging structure can properly position the electronic expansion valves 100, the dustproof cap members can only be arranged after two or more electronic expansion valves 100 are placed side by side in the same direction during packaging, which is more laborious to package. In application, it requires taking more than two electronic expansion valves 100 at the same time, which is very inconvenient.

Further, as for the electronic expansion valve 100 having a coil fixing bracket 106 sleeved on the valve body 101, as shown in FIG. 1, the dustproof cap member 200 is not applicable.

In view of this, how to improve the present packaging structure of the electronic expansion valve, to reduce the difficulty of packaging the electronic expansion valve, improve the packaging efficiency, and facilitate taking the electronic expansion valve is a technical problem to be solved by those skilled in the art at present.

SUMMARY

An object of the present application is to provide a packaging structure of an electronic expansion valve, to reduce the difficulty of packaging the electronic expansion valve, improve the packaging efficiency, and facilitate taking the electronic expansion valve.

To solve the above technology problems, a packaging structure for an electronic expansion valve is provided according to the present application, which includes a body for accommodating the electronic expansion valves, wherein the body includes more than one supporting portion, each supporting portion has first recess portions and second recess portions alternately arranged, the first recess portions and the second recess portions are all configured to support housings of the electronic expansion valves; and a center distance of each of the first recess portions and the adjacent second recess portion is the same as an outer diameter of the housing of each of the electronic expansion valves, to allow the housings of two of the electronic expansion valves to be attached together after the two electronic expansion valves are placed in an opposite direction.

When the packaging structure is used to package the electronic expansion valves, the every two adjacent electronic expansion valves are horizontally placed in the opposite direction. Here, "horizontally" means that an axis of the valve body of the electronic expansion valve is placed in a horizontal state, and "opposite direction" means that the orientations of the two electronic expansion valves are opposite. Taking the placement of the two adjacent electronic expansion valves in the packaging structure as an example, the placement of other electronic expansion valves is similar to this, which will not be repeated, and the housing of one of the electronic expansion valves is supported by the first recess portion of the supporting portion, correspondingly, the housing of another electronic expansion valve adjacent to the previous electronic expansion valve is supported by the second recess portion adjacent to the first recess portion. Since the center distance of the first recess portion and the adjacent second recess portion is the same as the outer diameter of the housing of the electronic expansion valve, so after being placed, the two housings of the two adjacent electronic expansion valves will be in close contact, and also, will abut against each other closely due to magnetic rotors inside the two electronic expansion valves attracting each other, which can prevent the rotation of the rotors during transportation that may result in changes in the factory-set opening degree of the electronic expansion valve.

As above, during packaging, the electronic expansion valves are independent of each other, it only needs to place each portion of the electronic expansion valve correspondingly in a corresponding portion of the packaging structure, and similarly, the electronic expansion valve can be taken separately, which is not affected by other valve members. Compared with the conventional technology that two or more electronic expansion valves are packaged and taken in a bundle, the packaging structure of the present application makes it more convenient and more efficient to package and take the electronic expansion valves.

Two sides of each supporting portion are respectively provided with a first accommodating portion and a second accommodating portion, the first accommodating portion is provided with a plurality of first accommodating positions corresponding to positions of the first recess portions respectively, the second accommodating portion is provided with a plurality of second accommodating positions corresponding to positions of the second recess portions respectively; and the first accommodating positions and the second accommodating positions are each configured to accommodate a valve body, a first connecting pipe and a second connecting pipe of a respective electronic expansion valve.

The first accommodating positions and the second accommodating positions each includes a valve-body accommodating portion for accommodating the valve body, a first-connecting-pipe accommodating portion for accommodating the first connecting pipe, and a second-connecting-pipe accommodating portion for accommodating the second connecting pipe; and the first-connecting-pipe accommodating portion is of a stepped structure including a high step surface toward the valve-body accommodating portion and a low step surface away from the valve-body accommodating portion; and the second-connecting-pipe accommodating portion is of an inclined surface structure.

An accommodating groove for allowing a coil fixing bracket of a respective electronic expansion valve to be embedded therein is provided between the valve-body accommodating portion of each of the first accommodating positions and the respective first recess portion; and another accommodating groove for allowing a coil fixing bracket of a respective electronic expansion valve to be embedded therein is also provided between the valve-body accommodating portion of each of the second accommodating positions and the respective second recess portion.

Each of the accommodating grooves is provided with an arc-shaped groove section fitting with an outer periphery of the coil fixing bracket.

The first connecting pipe is a vertical connecting pipe coaxial with the valve body, the second connecting pipe is a bent pipe provided at a side of the valve body, and the second connecting pipe includes a transverse pipe section and a vertical pipe section; and the first accommodating positions and the second accommodating positions are each respectively provided with a barrier member, to allow the vertical connecting pipe and the vertical pipe section to be respectively located at two sides of the barrier member after the electronic expansion valve is placed.

A side, away from the supporting portion, of each of the first accommodating positions and the second accommodating positions is provided with a stopping portion for abutting against the first connecting pipe.

The first accommodating positions and the second accommodating positions each includes a valve-body plane portion for supporting the valve body, a connecting-pipe plane portion for supporting the first connecting pipe, and a connecting-pipe inclined surface portion for supporting the second connecting pipe.

An accommodating groove for allowing a coil fixing bracket of a respective electronic expansion valve to be embedded therein is provided between the valve-body plane portion of each of the first accommodating positions and the respective first recess portion;

and another accommodating groove for allowing a coil fixing bracket of a respective electronic expansion valve to be embedded therein is also provided between the valve-body plane portion of each of the second accommodating positions and the respective second recess portion.

Two sides of each supporting portion are respectively provided with a first clamping portion and a second clamping portion, the first clamping portion is provided with a plurality of first clamping slots corresponding to positions of the first recess portions respectively, the second clamping portion is provided with a plurality of second clamping slots corresponding to positions of the second recess portions respectively; and the first clamping slots and the second clamping slots are each configured to clamp a first connecting pipe or a valve body of a respective electronic expansion valve; and a first accommodating space configured to accommodate second connecting pipes of the respective electronic expansion valves is provided between the supporting portion and the first clamping portion, and a second accommodating space configured to accommodate second connecting pipes of the respective electronic expansion valves is provided between the supporting portion and the second clamping portion.

A bottom of the first accommodating space is provided with a plurality of first cavities corresponding to positions of the first recess portions respectively; a bottom of the second accommodating space is provided with a plurality of second cavities corresponding to positions of the second recess portions respectively; and the first cavities and the second cavities are each configured to limit the position of the respective second connecting pipe.

An outer side of the first clamping portion and an outer side of the second clamping portion are each provided with a stopping portion for abutting against the respective first connecting pipe.

Opposite two sidewalls of the body are both provided with recessed steps, and the recessed steps on the two sidewalls are asymmetrically arranged.

The packaging structure further includes a plurality of dustproof covers configured to enclose nozzles of connecting pipes of the electronic expansion valves.

The packaging structure further includes a protective film configured to wrap all of the electronic expansion valves placed in the body.

The packaging structure further includes a cover plate configured to block an opening of the body.

The body has a blister plate structure.

Figure 1:
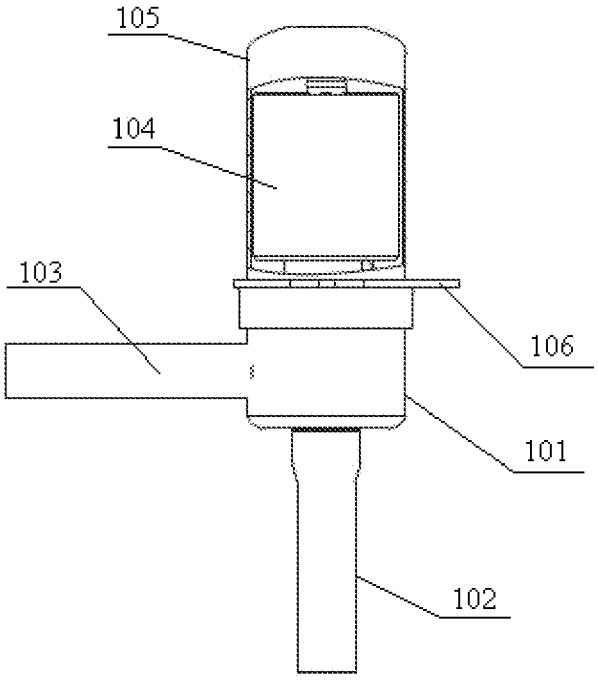
Figure 1 (Prior Art)
FIG. 1 is a schematic view showing the structure of a typical electronic expansion valve in the conventional technology.
Figure 2:
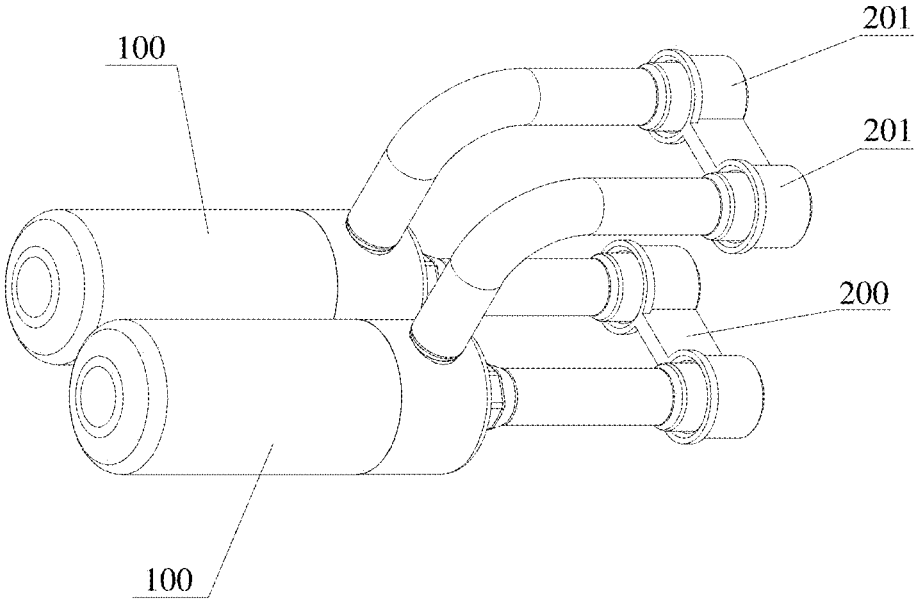
Figure 2 (Prior Art)
FIG. 2 is a schematic view showing a packaging structure of an electronic expansion valve in the conventional technology.

Reference Numerals:

| | | | |
|---|---|---|---|
| 101 | valve body, | 102 | first connecting pipe, |
| 103 | second connecting pipe, | 104 | magnetic rotor, |
| 105 | housing, | 106 | coil fixing bracket; |
| 200 | dustproof cap member, | 201 | dustproof cap; |
| 300 | body, | 301 | supporting portion, |
| 311a | first recess portion, | 311b | second recess portion, |
| 302 | first clamping portion, | 321 | first clamping slot, |
| 303 | second clamping portion, | 331 | second clamping slot, |
| 305 | second accommodating space, | 306 | longitudinal sidewall, |
| 361 | rib; | | |
| 400 | cover plate, | 500 | dustproof cover; |
| 300' | body, | 301' | supporting portion, |
| 311a' | first recess portion, | 311b' | second recess portion, |
| 302a' | first accommodating position, | 302b' | second accommodating position, |
| 322' | first-connecting-pipe accommodating portion, | | |
| 3221' | high step surface, | | |
| 323' | second-connecting-pipe accommodating portion, | | |
| 3222' | low step surface, | | |
| 303' | accommodating groove, | 304' | baffle, |
| 305' | barrier pillar, | 306' | recessed step, |
| 300" | body, | 301" | supporting portion, |
| 311a" | first recess portion, | 311b" | second recess portion, |
| 302a" | first accommodating position, | 302b" | second accommodating position, |
| 321" | valve-body plane portion, | 322" | connecting-pipe plane portion, |
| 323" | connecting-pipe inclined surface portion, | 303" | accommodating groove, |
| 304" | supporting table, | 305" | supporting pillar, |
| 306" | recessed step. | | |

DETAILED DESCRIPTION

A core of the present application is to provide a packaging structure of an electronic expansion valve, which can reduce the difficulty of packaging the electronic expansion valve, improve the packaging efficiency, and facilitate taking the electronic expansion valve.

The packaging structure of an electronic expansion valve is provided according to the present application, which includes a body for accommodating the electronic expansion valve, the body includes more than one supporting portion, each supporting portion has first recess portions and second recess portions alternately arranged, and the first recess portions and the second recess portions are each configured to support a housing of the electronic expansion valve. A center distance of the first recess portion and the adjacent second recess portion is the same as an outer diameter of the housing of the electronic expansion valve, so that after two of the electronic expansion valves are placed in an opposite direction, the housings of the two electronic expansion valves are attached together.

When the packaging structure is used to package the electronic expansion valves, the every two adjacent electronic expansion valves are horizontally placed in the opposite direction. Here, "horizontally" means that an axis of the valve body of the electronic expansion valve is placed in a horizontal state, and "opposite direction" means that the orientations of the two electronic expansion valves are opposite. Taking the placement of the two adjacent electronic expansion valves in the packaging structure as an example, the placement of other electronic expansion valves is similar to this, which will not be repeated, and the housing of one of the electronic expansion valves is supported by the first recess portion of the supporting portion, correspondingly, the housing of another electronic expansion valve adjacent to the previous electronic expansion valve is supported by the second recess portion adjacent to the first recess portion. Since the center distance of the first recess portion and the adjacent second recess portion is the same as the outer diameter of the housing of the electronic expansion valve, so after being placed, the two housings of the two adjacent electronic expansion valves will be in close contact, and also, will abut against each other closely due to magnetic rotors inside the two electronic expansion valves attracting each other, which can prevent the rotation of the rotors during transportation that may result in changes in the factory-set opening degree of the electronic expansion valve.

With the above arrangement, during packaging, the electronic expansion valves are independent of each other, it only needs to place each portion of the electronic expansion valve correspondingly in a corresponding portion of the packaging structure, and similarly, the electronic expansion valve can be taken separately, which is not affected by other valve members. Compared with the conventional technology that two or more electronic expansion valves are packaged and taken in a bundle, the packaging structure of the present application makes it more convenient and more efficient to package and take the electronic expansion valves.

Two sides of each of the supporting portions are respectively provided with accommodating cavities for accommodating other structures of the electronic expansion valve other than the housing. To make a person skilled in the art better understand the solution of the present application, the present application will be further described in detail below in conjunction with the drawings and embodiments.

Figure 3:
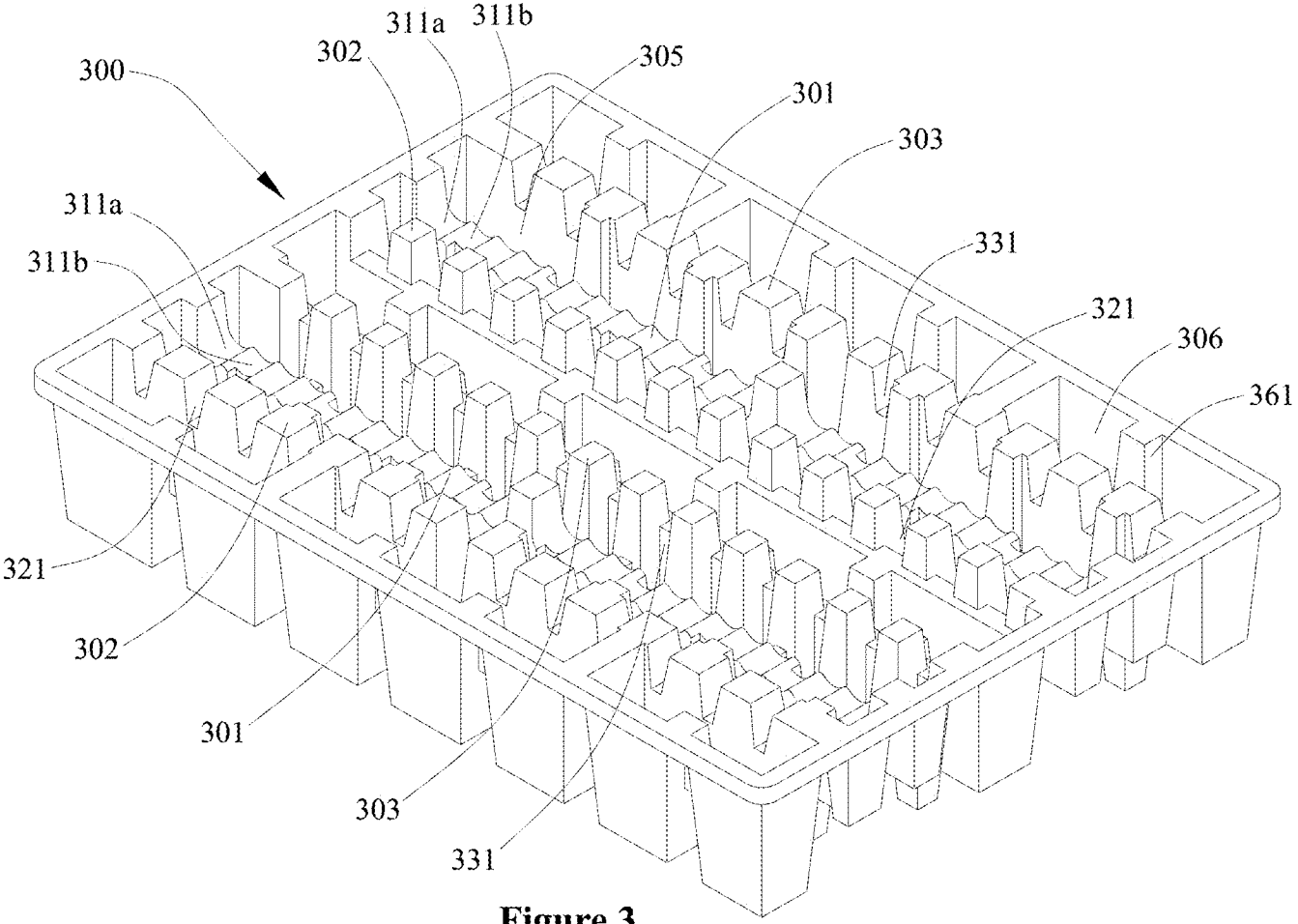
FIG. 3 is a schematic view showing the structure of a body of a packaging structure according to a first embodiment of the present application.
Figure 5:
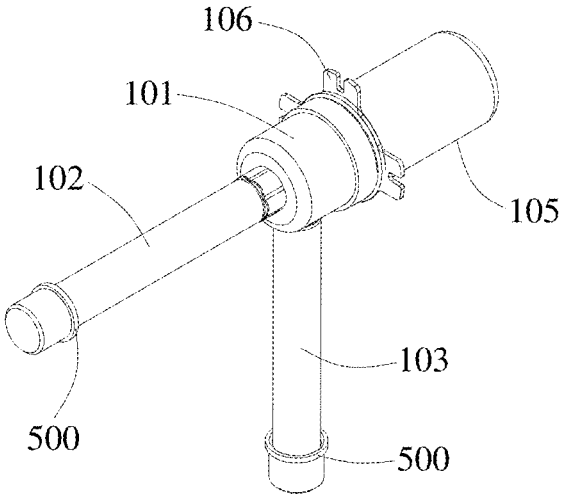
Figure 5 (Prior Art)
FIG. 5 is a schematic view showing the structure of an electronic expansion valve to be packaged.

Referring to FIG. 3 and FIG. 5, FIG. 3 is a schematic view showing the structure of a body of a packaging structure according to a first embodiment of the present application; FIG. 5 is a schematic view showing the structure of an electronic expansion valve to be packaged.

The structure of the electronic expansion valve 100 is identical to that in FIG. 1, the first connecting pipe 102 is a vertical connecting pipe coaxial with the valve body 101, and the second connecting pipe 103 is a transverse connecting pipe approximately perpendicular to the axis of the valve body 101, and other structures will not be described in detail.

As shown in FIG. 3, in this embodiment, the packaging structure includes a body 300, and the body 300 includes two supporting portions 301 which are arranged in parallel and spaced apart by a predetermined distance.

Each of the supporting portions 301 is provided with first recess portions 311*a* and second recess portions 311*b* which are alternately arranged, and the first recess portions 311*a* and the second recess portions 311*b* are each configured to support the housing 105 of the electronic expansion valve 100. A center distance of the first recess portion 311*a* and the adjacent second recess portion 311*b* is the same as an outer diameter of the housing of the electronic expansion valve 100.

Two sides of each supporting portion 301 are respectively provided with a first clamping portion 302 and a second clamping portion 303. Based on the orientation shown in FIG. 3, the first clamping portion 302 is located at the left side of the supporting portion 301, and the second clamping portion 303 is located at the right side of the supporting portion 301. The first clamping portion 302 has multiple first clamping slots 321 respectively corresponding to the positions of the first recess portions 311*a*, and the second clamping portion 303 has multiple second clamping slots 331 respectively corresponding to the positions of the second recess portions 311*b*. The first clamping slots 321 and the second clamping slots 331 are each configured to clamp the first connecting pipe 102 of the electronic expansion valve 100, that is, the connecting pipe that coincides with the axis of the valve body 101.

A first accommodating space configured to accommodate the second connecting pipe 103 of the electronic expansion valve 100 is provided between the supporting portion 301 and the first clamping portion 302, and a second accommodating space configured to accommodate the second connecting pipe 103 of the electronic expansion valve 100 is provided between the supporting portion 301 and the second clamping portion 303.

It can be understood that when the housing 105 of the electronic expansion valve 100 is supported by one of the first recess portions 311*a*, the first connecting pipe 102 is clamped in the first clamping slot 321 corresponding to the position of the first recess portion 311*a*, and the second connecting pipe 103 is accommodated in the first accommodating space. When the housing 105 of the electronic expansion 100 is supported by one of the second recess portions 311*b*, the first connecting pipe 102 is clamped in the second clamping slot 331 corresponding to the position of the second recess portion 311*b*, and the second connecting pipe 103 is accommodated in the second accommodating space 305.

It should be noted that, in terms of structure, the structures of the first recess portion 311*a* and the second recess portion 311*b* are the same or similar, the structures of the first clamping slot 321 of the first clamping portion 302 and the second clamping slot 331 of the second clamping portion 303 are the same or similar, the structures of the first accommodating space and the second accommodating space 305 are the same or similar, and the "first" and "second" herein are merely for the sake of clarity and convenience of describing the technical solution, do not indicate the order, and should not be construed as a certain limitation.

When the packaging structure is used to package the electronic expansion valves 100, every two adjacent electronic expansion valves 100 are horizontally placed in the opposite direction. Here, the "horizontally" means that an axis of the valve body 101 of the electronic expansion valve 100 is placed in a horizontal state and the "opposite direction" means that the orientations of the two electronic expansion valves 100 are opposite. According to the specific description of the packaging structure, since the clamping portions for clamping the first connecting pipes 102 of the electronic expansion valves 100 are alternately arranged at two sides of each of the supporting portions 301, after the electronic expansion valves 100 are placed in sequence, the adjacent electronic expansion valves 100 are in a horizontal and opposite state.

Taking the placement of two adjacent electronic expansion valves in the packaging structure as an example, the housing 105 of one of the electronic expansion valves 100 is supported by the first recess portion 311*a* of the supporting portion 301, the first connecting pipe 102 is clamped in the first clamping slot 321 corresponding to the first recess portion 311*a*, so that the second connecting pipe 103 can be placed in the first accommodating space between the supporting portion 301 and the first clamping portion 302. Correspondingly, the housing 105 of another electronic expansion valve 100 adjacent to the previous electronic expansion valve 100 is supported by the second recess portion 311*b* adjacent to the first recess portion 311*a*, the first connecting pipe 102 is clamped in the second clamping slot 331 corresponding to the second recess portion 311*b*, so that the second connecting pipe 103 can be placed in the second accommodating space 305 between the supporting portion 301 and the second clamping portion 303. Since the center distance of the first recess portion 311*a* and the adjacent second recess portion 311*b* is the same as an outer diameter of the housing 105 of the electronic expansion valve 100, so after being placed as above, the two housings 105 of the two adjacent electronic expansion valves 100 will be in close contact, and also will abut against each other closely due to magnetic rotors 104 inside the two electronic expansion valves 100 attracting each other, which can prevent the rotation of the rotors during transportation that may result in changes in the factory-set opening degree of the electronic expansion valve 100.

Figure 4:
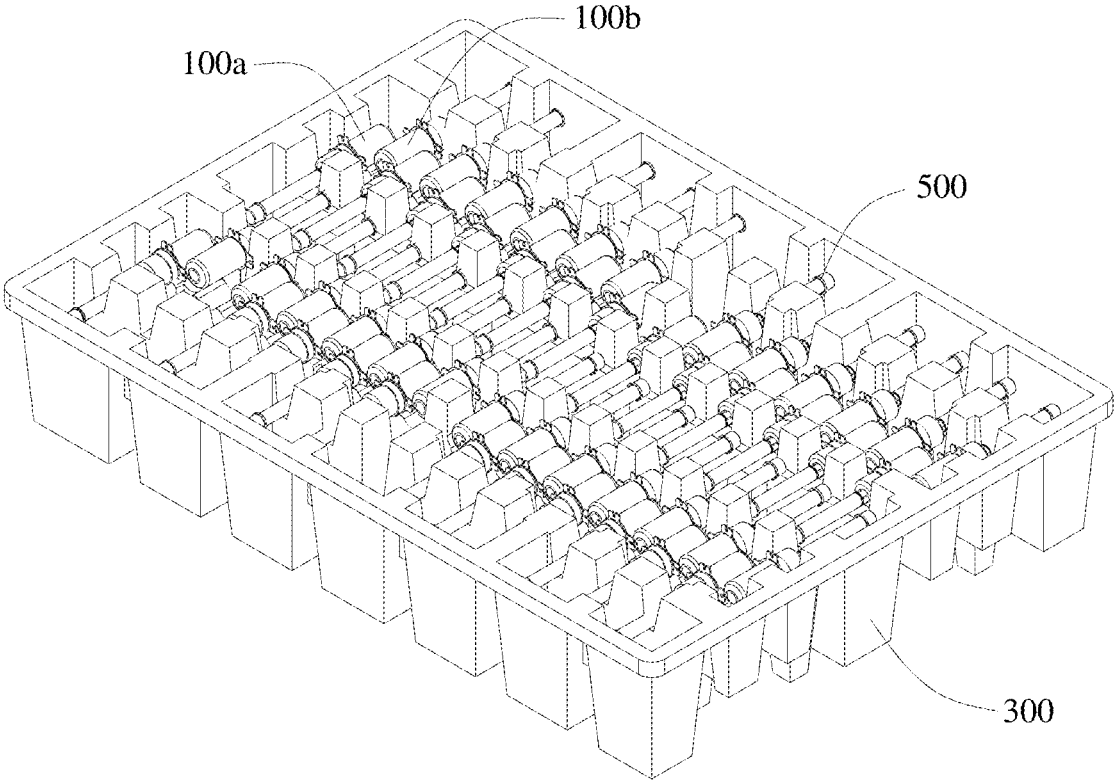
FIG. 4 is a schematic view showing the structure of the body shown in FIG. 3 filled with electronic expansion valves.

The body of the packaging structure filled with the electronic expansion valves 100 can be understood with reference to FIG. 4. According to this embodiment, the body 300 of the packaging structure accommodates the electronic expansion valves 100 with the structure shown in FIG. 5, that is, the second connecting pipe 103 is a transverse connecting pipe. As shown in FIG. 4, an electronic expansion valve 100*a* is placed in the first recess portion 311*a* of the supporting portion 301, the corresponding first clamping slot 321 and the first accommodating space, and an electronic expansion valve 100*b* adjacent to the electronic expansion valves 100*a* is placed in the second recess portion 311*b* of the supporting portion 301, the corresponding second clamping slot 331 and the second accommodating space 305.

As above, during packaging, the electronic expansion valves 100 are independent of each other, it only needs to place each portion of the electronic expansion valve 100 correspondingly in a corresponding portion of the packaging structure, and similarly, the electronic expansion valve 100 can be taken separately, which is not affected by other valve members. Compared with the conventional technology that two or more electronic expansion valves 100 are packaged and taken in a bundle, the packaging structure of the present application makes it more convenient and more efficient to package and take the electronic expansion valves 100.

In addition, in conjunction with FIG. 4, after the electronic expansion valves 100 are placed in the body 300 of the packaging structure, the coil fixing brackets 106 fixed on the valve bodies 101 are located in the accommodating space between the supporting portion 301 and the clamping portion. The adjacent two electronic expansion valves 100 are horizontally arranged in the opposite direction, thus the arrangement of the coil fixing brackets 106 does not affect the close contact of the housings 105 of the two electronic expansion valves 100, that is, the coil fixing brackets 106 does not affect the positioning of the electronic expansion valves 100, and the packaging structure is applicable to package and transportation of the electronic expansion valves 100 having the coil fixing brackets 106.

As shown in FIG. 3, the body 300 of the packaging structure according to this embodiment is provided with two sets of the supporting portions 301, the clamping portions (including the first clamping portion 302 and the second clamping portion 303), and the accommodating spaces (including the first accommodating space and the second accommodating space 305), and one body 300 can accommodate multiple electronic expansion valves 100. It should be understood that, in the actual setting, the body 300 of the packaging structure may be provided with only one set of the supporting portion 301, the clamping portions and the accommodating spaces, and of course, may also be provided with more sets of the supporting portion 301, the clamping portions and the accommodating spaces according to the requirements.

According to this embodiment, the first clamping slot 321 of the first clamping portion 302 is configured to clamp the first connecting pipe 102 of the electronic expansion valve 100. In the actual setting, an appropriate distance may be set between the first clamping portion 302 and the supporting portion 301, so that when the housing 105 of the electronic expansion valve 100 is placed in the first recess portion 311*a* of the supporting portion 301 and the first connecting pipe 102 is clamped in the first clamping slot 321, an end surface of the valve body 101 of the electronic expansion valve 100 abuts against the end surface, facing the supporting portion 301, of the first clamping portion 302, so as to limit the position of the valve body 101. Correspondingly, an appropriate distance may also be set between the second clamping portion 303 and the supporting portion 301, so that the end surface, facing the supporting portion 301, of the second clamping portion 303 can abut against the end surface of the valve body 101, so as to limit the position of the valve body 101.

In addition, in the actual setting, the first clamping slot 321 of the first clamping portion 302 and the second clamping slot 331 of the second clamping portion 303 can also be used to clamp the valve body 101 of the electronic expansion valve 100, and obviously, by clamping the end, close to the first connecting pipe 102, of the valve body 101 in the engaging slot, it can avoid interference with the second connecting pipe 103.

Further, the bottom of the first accommodating space is provided with multiple first cavities, and the multiple first cavities correspond to the positions of the first recess portions 311*a* respectively; the bottom of the second accommodating space 305 is provided with multiple second cavities, and the multiple second cavities correspond to the positions of the second recess portions 311*b* respectively; and the first cavities and the second cavities are each configured to limit the position of the second connecting pipe 103 of the electronic expansion valve 100. Thus, after the electronic expansion valve 100 is placed in the body 300, in addition that the electronic expansion valve 100 is attracted to the adjacent electronic expansion valve 100 by an electromagnetic force, the position of its second connecting pipe 103 is also limited, and thus the positioning is more reliable.

Obviously, each of the first cavities and the second cavities should be match the structure of the second connecting pipe 103, that is, if the second connecting pipe 103 of the electronic expansion valve 100 is in the form of a straight pipe as shown in FIG. 5, each of the first cavities and the second cavities is set as a circular cavity matching the end of the second connecting pipe 103, and after the electronic expansion valve 100 is placed, its second connecting pipe 103 can be inserted into the first cavity or the second cavity to realize positioning. If the second connecting pipe of the electronic expansion valve 100 is in the form of a bent pipe, each of the first cavities and the second cavities matches the bent second connecting pipe, so that after the electronic expansion valve is placed, the bent second connecting pipe can be clamped in the first cavity or the second cavity to achieve position limitation.

In a specific solution, the outer side of the first clamping portion 302 and the outer side of the second clamping portion 303, that is, the side away from the corresponding supporting portion 301, are each provided with a stopping portion for abutting against the first connecting pipe 102 of the electronic expansion valve 100, to limit the movement of the electronic expansion valve 100 in the horizontal direction.

Specifically, according to this embodiment, by taking the orientation of the body 300 shown in FIG. 3 as the reference, the outer side of the second clamping portion 303 of the right supporting portion 301 is provided with a longitudinal sidewall 306 of the body 300. In practice, in order to simplify the structure of the body 300 and save materials, the longitudinal sidewall 306 can be used as the stopping portion for the first connecting pipe 102, clamped in the second clamping portion 303, of the electronic expansion valve 100. In conjunction with FIG. 4, the outer side of the first clamping portion 302 of the right supporting portion 301 is provided with the second recess portion 303 of the left supporting portion 301, and in order to reduce the space, the second clamping portion 303 of the left supporting portion 301 can be used as the stopping portion for the first connecting pipe 102, clamped in the first clamping portion 302 of the right supporting portion 301, of the electronic expansion valve 100.

Correspondingly, for the electronic expansion valve 100 placed on the left supporting portion 301, the longitudinal sidewall 306 at the left side of the body 300 can be used as the stopping portion for the first connecting pipe 102, clamped in the left first clamping portion 302, of the electronic expansion valve 100, and the first clamping portion 302 near the right side can be used as the stopping portion for the first connecting pipe 102, clamped in the left second clamping portion 303, of the electronic expansion valve 100.

With the above arrangement, referring to FIG. 4, after the body is filled with the electronic expansion valves 100, the first connecting pipes 102 of the two columns of electronic expansion valves 100 near the middle substantially share the same space of the body 300, which can reduce the transverse dimension of the body 300.

It can be understood that if the body 300 is provided with more supporting portions 301 and corresponding structures, the stopping portions can also be similarly arranged.

When the body 300 is provided with only one supporting portion 301 and corresponding structures, the two longitudinal sidewalls of the body 300 form the above stopping portions, respectively abutting against the first connecting pipes 102, supported by the same supporting portion 301, of the two electronic expansion valves 100 that are opposite to each other.

When the body 300 is provided with more than two supporting portions 301, the stopping portions may also be set as follows: the two longitudinal sidewalls 306 of the body 300 are still stopping portions for the first connecting pipes 102 of the electronic expansion valves 100 placed adjacent to the longitudinal sidewalls 306. Two clamping portions are provided between the two supporting portions 301, one clamping portion forming the first clamping portion for one of the two supporting portions 301, and the other clamping portion forming the second clamping portion for the other of the two supporting portions 301. A partition may be provided between the two clamping portions, and the two sidewalls of the partition may be served as stopping portions for the first connecting pipes 102 of the electronic expansion valves 100 placed adjacent to the partition.

Compared with the body 300 shown in FIG. 4, the above solution is equivalent to enlarge the distance between the first clamping portion 302 and the second clamping portion 303 which are between the two supporting portions 301, that is, a partition for stopping is provided between the first clamping portion 302 and the second clamping portion 303.

In a specific solution, the body 300 may be a pulp molded product or a blister board. Referring to FIG. 3, in a specific arrangement, multiple vertically extending ribs 361 may be provided on the longitudinal sidewall 306 of the body 300 to increase the strength of the body 300. The number and the layout of the ribs 361 can be set according to the requirements as long as it does not affect the placement of the electronic expansion valves 100.

Figure 6:
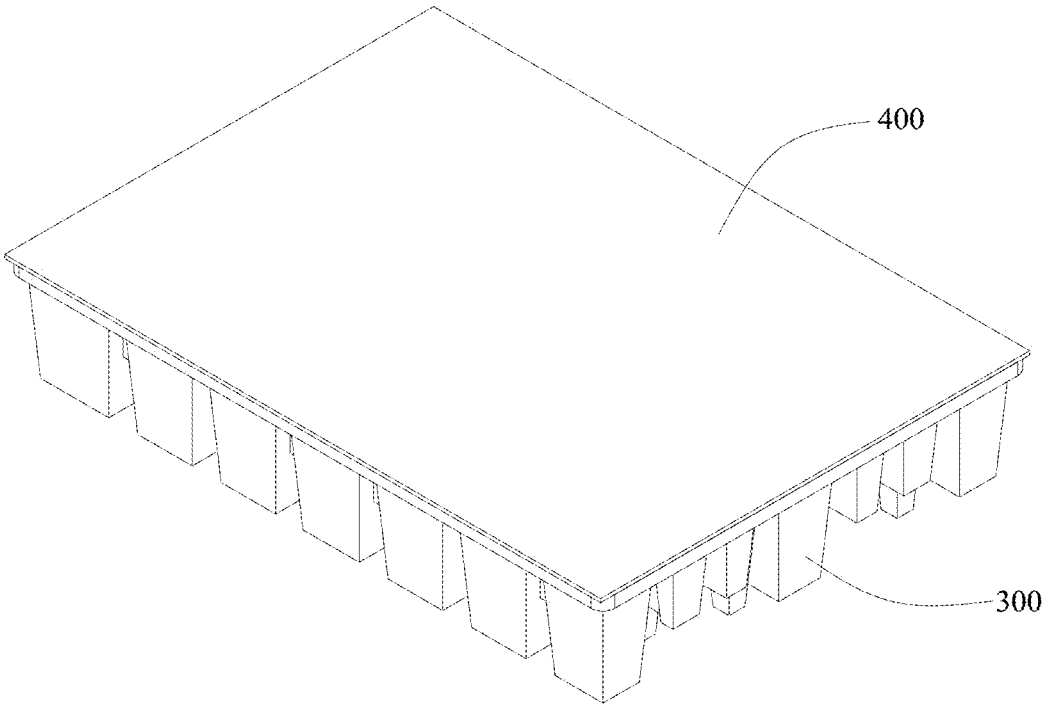
FIG. 6 is a schematic view showing the structure of the body in FIG. 4 covered with a cover plate.

In a specific solution, in addition to the body 300, the packaging structure is further provided with a cover plate 400 to block the opening of the body 300. After the body 300 is filled with the electronic expansion valves 100, the cover plate 400 can be covered thereon, as shown in FIG. 6, in this way, it is convenient to place multiple layers of packaging structures in an outer packaging box, and the cover plate 400 can be regarded as the partition between the bodies 300.

In a specific solution, the packaging structure further includes multiple dustproof covers 500 for enclosing the nozzle of the first connecting pipe 102 and the nozzle of the second connecting pipe 103 of the electronic expansion valve 100, to prevent dust or debris from entering the interior of the valve. It is obvious that the dustproof covers 500 are independent of each other, to prevent the packages of the electronic expansion valves 100 from interfering with each other.

In a specific solution, the packaging structure further includes a protective film configured to wrap all of the electronic expansion valves placed in the body 300. In a specific operation, the protective film is first placed in the recess of the empty body 300, then the electronic expansion valves 100 are sequentially placed in the body 300, and after the body 300 is filled up, the protective film is folded to completely wrap the electronic expansion valves 100, thereby achieving the dustproof and moisture-proof functions.

Specifically, the protective film can be a plastic film, to prevent breakage when being folded.

Figure 7:
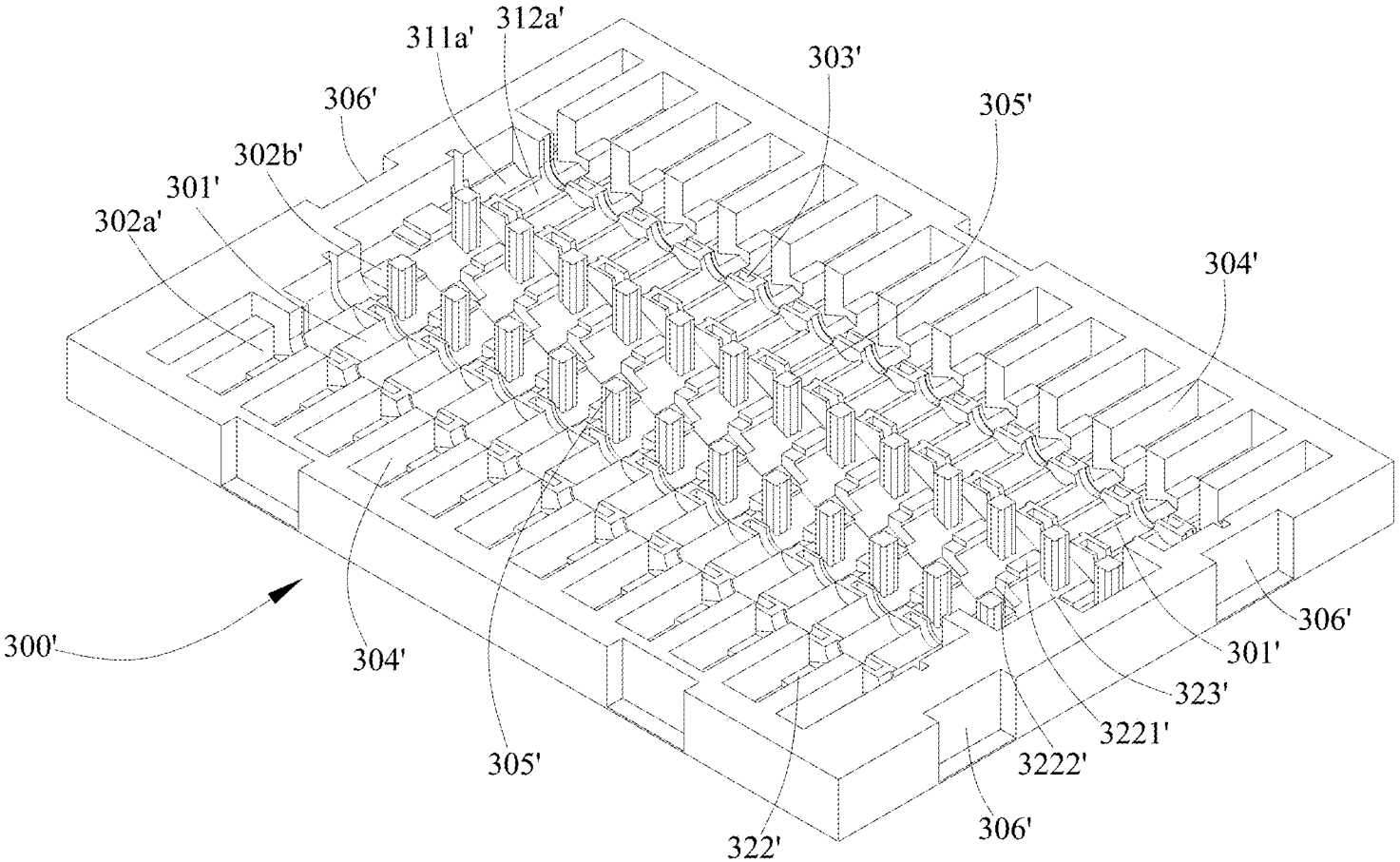
FIG. 7 is a schematic view showing the structure of a body of a packaging structure according to a second embodiment of the present application.

Referring to FIG. 7, FIG. 7 is a schematic view showing the structure of a body of a packaging structure according to a second embodiment of the present application.

In this embodiment, the body 300' of the packaging structure is also provided with two supporting portions 301', and similarly, the two supporting portions 301' are arranged in parallel and spaced apart by a predetermined distance.

Each of the supporting portions 301' is provided with first recess portions 311*a*' and second recess portions 311*b*' which are alternately arranged, and the first recess portions 311*a*' and the second recess portions 311*b*' are each configured to support the housing 105 of the electronic expansion valve 100. A center distance of the first recess portion 311*a*' and the adjacent second recess portion 311*b*' is the same as an outer diameter of the housing of the electronic expansion valve 100.

Two sides of each supporting portions 310' are respectively provided with a first accommodating portion and a second accommodating portion. The first accommodating portion is provided with multiple first accommodating positions 302*a*' corresponding to the positions of the first recess portions 311*a*' respectively, and each of the first accommodating positions 302*a*' is configured to accommodate other main structures of the electronic expansion valve 100 supported by the first recess portion 311*a*' other than the housing 105, such as the valve body 101, the first connecting pipe 102, and the second connecting pipe 103.

Similarly, the second accommodating portion 302*b*' is provided with multiple second accommodating positions 302*b*' corresponding to the positions of the second recess portions 311*b*' respectively, and each of the second accommodating positions 302*b*' is configured to accommodate other main structures of the electronic expansion valve 100 supported by the second recess portion 311*b*' other than the housing 105, such as the valve body 101, the first connecting pipe 102, and the second connecting pipe 103.

In a specific solution, the first accommodating positions 302*a*' and the second accommodating positions 302*b*' each includes a valve-body accommodating portion for accommodating the valve body 101, a first-connecting-pipe accommodating portion 322' for accommodating the first connecting pipe 102, and a second-connecting-pipe accommodating portion 323' for accommodating the second connecting pipe 103.

The first-connecting-pipe accommodating portion 322' is of a stepped structure, including a high step surface 3221' close to the valve-body accommodating portion and a low step surface 3222' away from the valve-body accommodating portion. With this design, it is convenient for the first connecting pipe 102 to be smoothly supported after the nozzle of the first connecting pipe 102 is enclosed by the dustproof cover 500. It can be understood that after the nozzle of the first connecting pipe 102 is enclosed by the dustproof cover 500, the size of the portion, with the dustproof cover 500, of the first connecting pipe 102 is larger than the size of the main body of the first connecting pipe 102. Thus, the high step surface 3221' can be configured to support the portion of the first connecting pipe 102 that is close to the valve body 101, and the dustproof cover 500 can be supported by the low step surface 3222', thereby improving the stability and safety of the electronic expansion valve 100 in the packaging structure.

Specifically, the second-connecting-pipe accommodating portion 323' may be configured as an inclined surface structure, and this design can help reduce the overall height of the body 300', and to reduce the overall height of the package box with the same number of packages.

In a specific solution, an accommodating groove 303' is provided between the valve-body accommodating portion of each of the first accommodating positions 302*a*' and the corresponding first recess portion 311*a*', and a coil fixing bracket 106 of the electronic expansion valve 100 at the corresponding position can be embedded in the accommodating groove 303'. Similarly, another accommodating groove 303' is also provided between the valve-body accommodating portion of each of the second accommodating positions 302*b*' and the corresponding second recess portion 311*b*', and the coil fixing bracket 106 of the electronic expansion valve 100 at the corresponding position can be embedded in this accommodating groove 303'.

With the above setting, after the electronic expansion valves 100 are placed, the coil fixing brackets 106 are embedded in the accommodating grooves 303', which can prevent the electronic expansion valves 100 from moving back and forth in the axial direction to wear the valve body structure.

Specifically, the accommodating groove 303' is further provided with an arc-shaped groove section fitting with an outer periphery of the coil fixing bracket 106, which can prevent the relative rotation of the valve body 101 of the electronic expansion valve 100, thereby avoiding damages to the valve structure.

Figure 10:
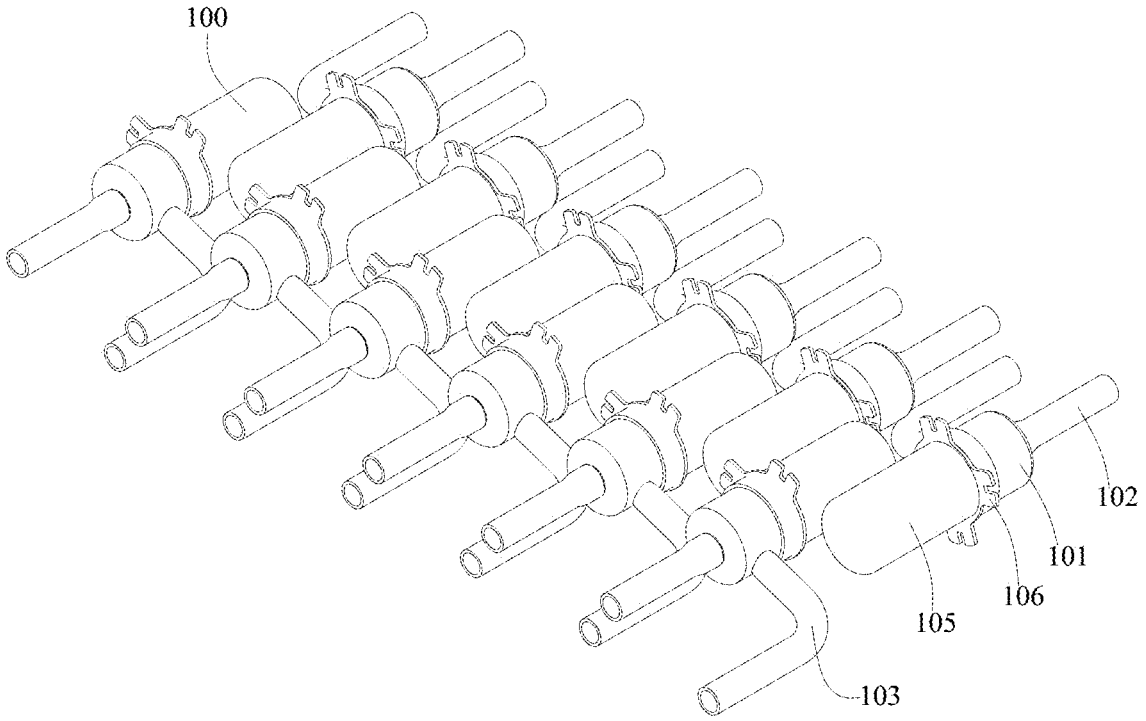
FIG. 10 is a schematic view showing the placing state of another electronic expansion valve in a packaging structure.

In a specific solution, when the packaging structure is used to package the electronic expansion valve 100 as shown in FIG. 10, the first accommodating position 302*a*' and the second accommodating position 302*b*' are each provided with a barrier member. The second connecting pipe 103 of the electronic expansion valve 100 is of a bent pipe structure including a transverse pipe section and a vertical pipe section.

After the electronic expansion valve 100 is placed, the barrier member can isolate the first connecting pipe 102 from the vertical pipe section of the second connecting pipe 103, and the arrangement of the barrier member can limit the position of the electronic expansion valve 100, to prevent the electronic expansion valve 100 from shaking in the packaging structure In a specific solution, the side, away from the supporting portion 301', of each of the first accommodating position 302*a*' and the second accommodating position 302*b*' is provided with a stopping portion for abutting against the first connecting pipe 102.

In this embodiment, by taking the orientation of the body 300' shown in FIG. 7 as the reference, the front side of the first accommodating position 302*a*' of the front-side supporting portion 301' is the longitudinal sidewall of the body 300'. In practice, in order to simplify the structure and save materials, the longitudinal sidewall can be used as the stopping portion for the first connecting pipe 102 of the electronic expansion valve 100 placed in the first accommodating position 302*a*'. The rear side of the second accommodating position 302*b*' of the front-side supporting portion 301' is provided with a stopping portion for abutting the first connecting pipe 102 of the electronic expansion valve 100 placed in the second accommodating position 302*b*', and the stopping portion is specifically embodied as multiple barrier pillars 305' corresponding to the second accommodating position 302*b*' near the rear side.

It is to be noted that, in this embodiment, in order to simplify the structure, one row of the barrier pillars 305' near the rear side can also be served as the barrier member for the first accommodating position 302*a*' of the rear-side supporting portion 301'.

As shown in FIG. 7, in this embodiment, the barrier member of the first accommodating position 302*a*' of the front-side supporting portion 301' is specifically embodied as baffles 304', and the baffles 304' are fixedly connected to the longitudinal sidewall at the front side. As shown in FIG. 7, it can be understood that, the arrangement of the baffles 304' is equivalent to dividing the first accommodating portion into multiple relatively independent chambers, two chambers at two ends respectively accommodate the first connecting pipe 102 of the electronic expansion valve 100 at the position corresponding to one end and the second connecting pipe 103 of the electronic expansion valve 100 at the position corresponding to the other end; and each of the remaining chambers accommodate the first connecting pipe 102 of the electronic expansion valve 100 at the position corresponding to the chamber and the second connecting pipe 103 of the electronic expansion valve 100 adjacent to this position.

It should be understood that, the baffle 304' described above can actually be replaced with the barrier pillar, and in comparison, the plate-like structure of the baffle 304' can enhance the overall strength of the body 300'.

The specific structure of the supporting portion 301' at the rear side is similar to that as described above and will not be described again.

In a specific solution, the body 300' may be a pulp molded product or a blister plate product.

Specifically, the opposite two sidewalls of the body 300' can be both provided with recessed steps 306', and the recessed steps 306' on the two sidewalls are asymmetrically arranged. In the solution as shown in FIG. 7, one of the opposite two sidewalls is provided with one recessed step 306' and the other is provided with two recessed steps 306'.

In practice, when packaging, the bodies 300' are stacked and placed in an outer package box. With the above design, when the bodies 300' are stacked, the sidewall of one body 300' having one recessed step 306' can be located at the same side as the sidewall of the adjacent body 300' having two recessed steps 306', so that after stacking, the recessed steps 306' at the same side of the adjacent two bodies 300' are staggered, which facilitates taking and carrying the bodies.

It should be noted that the structure of the body 300 according to the first embodiment may also be provided with a similar structure on the sidewall, to achieve the same effect. Similarly, the packaging structure provided according to the embodiment may also be provided with a cover plate to block the opening of the body 300', or a protective film to wrap the electronic expansion valves 100.

Figure 8:
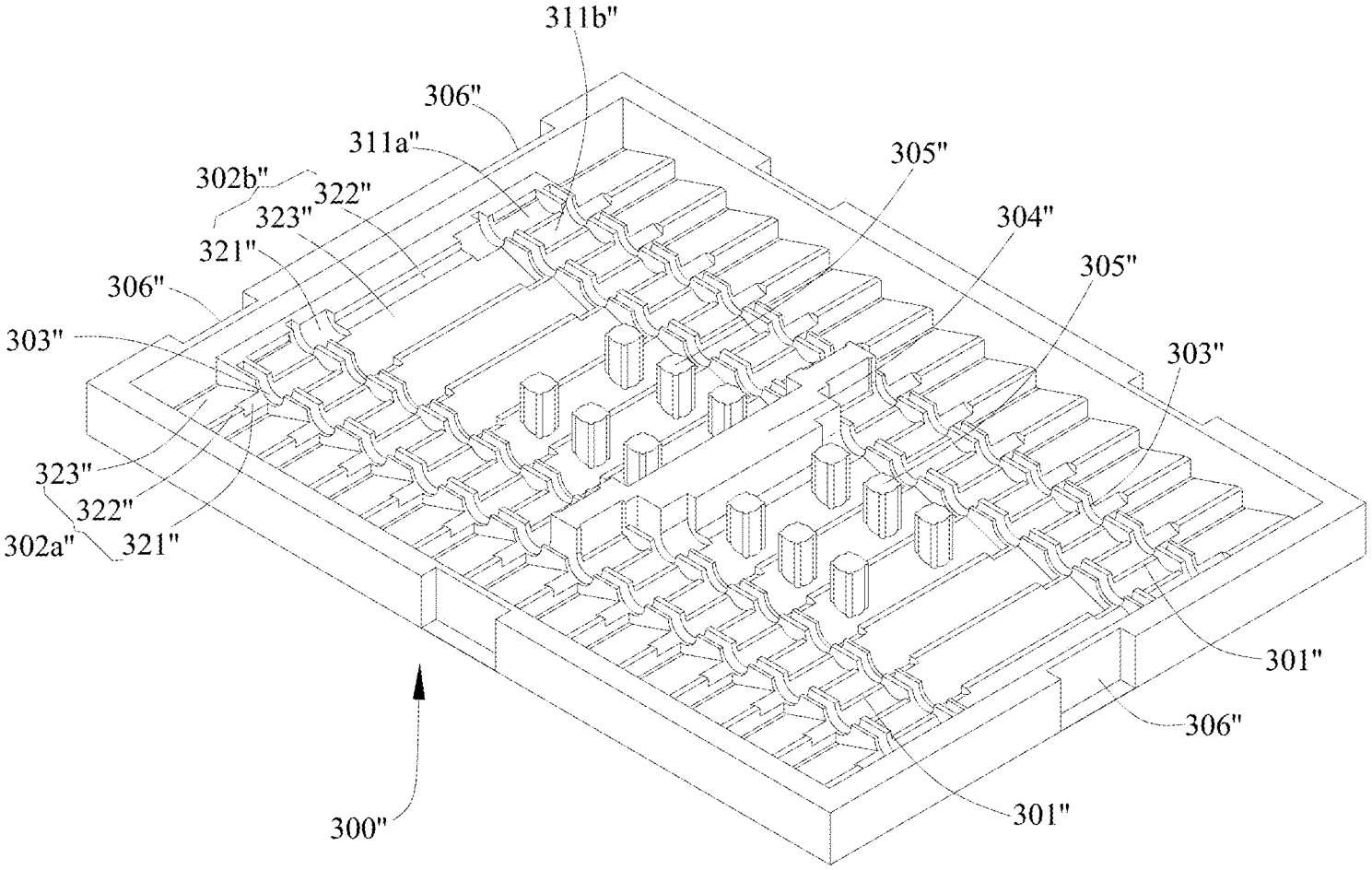
FIG. 8 is a schematic view showing the structure of a body of a packaging structure according to a third embodiment of the present application.
Figure 9:
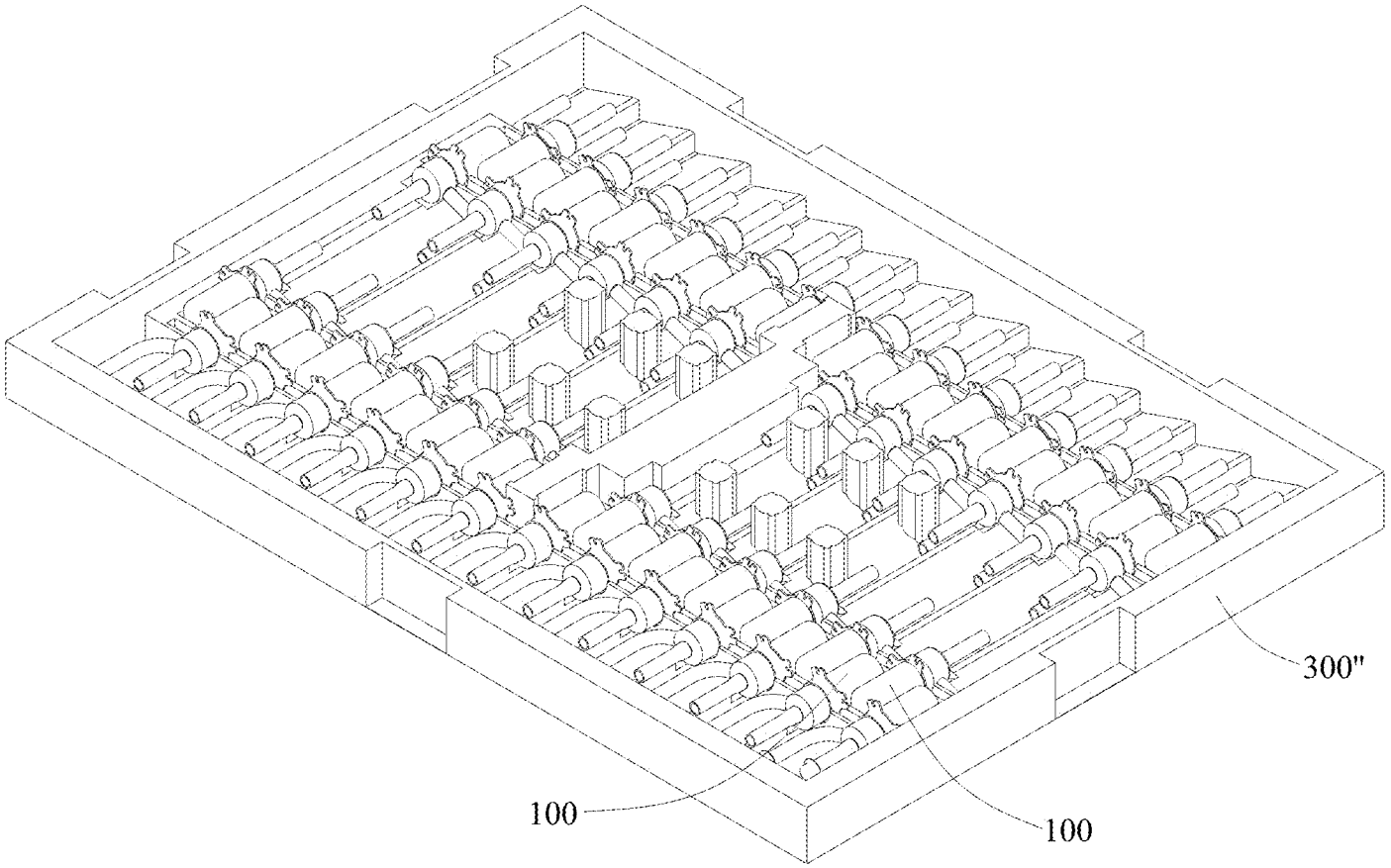
FIG. 9 is a schematic view showing the structure of the body shown in FIG. 8 filled with electronic expansion valves.

Referring to FIGS. 8 and 9, FIG. 8 is a schematic view showing the structure of a body of a packaging structure according to a third embodiment of the present application;

and FIG. 9 is a schematic view showing the structure of the body filled with electronic expansion valves shown in FIG. 8.

In this embodiment, the body 300" of the packaging structure is also provided with two supporting portions 301", and similarly, the two supporting portions 301" are arranged in parallel and spaced apart by a predetermined distance.

Each of the supporting portions 301" is provided with first recess portions 311*a*" and second recess portions 311*b*" which are alternately arranged, and the first recess portions 311*a*" and the second recess portions 311*b*" are each configured to support the housing 105 of the electronic expansion valve 100. A center distance of the first recess portion 311*a*" and the adjacent second recess portion 311*b*" is the same as an outer diameter of the housing of the electronic expansion valve 100.

Two sides of each supporting portion 310" are respectively provided with a first accommodating portion and a second accommodating portion. The first accommodating portion is provided with multiple first accommodating positions 302*a*" corresponding to the positions of the first recess portions 311*a*" respectively, and the first accommodating positions 302*a*" are each configured to accommodate other main structures of the electronic expansion valve 100 supported by the first recess portion 311*a*" other than the housing 105, such as the valve body 101, the first connecting pipe 102, and the second connecting pipe 103.

Similarly, the second accommodating portion 302*b*" is provided with multiple second accommodating positions 302*b*" corresponding to the positions of the second recess portions 311*b*" respectively, and the second accommodating positions 302*b*" are each configured to accommodate other main structures of the electronic expansion valve 100 supported by the second recess portion 311*b*" other than the housing 105, such as the valve body 101, the first connecting pipe 102, and the second connecting pipe 103.

In a specific solution, the first accommodating positions 302*a*" and the second accommodating positions 302*b*" each includes a valve-body plane portion 321" for supporting the valve body 101 of the electronic expansion valve 100, a connecting-pipe plane portion 322" for supporting the first connecting pipe 102 of the electronic expansion valve 100, and a connecting-pipe inclined surface portion 323" for supporting the second connecting pipe of the electronic expansion valve 100.

As described above, the portion for supporting the second connecting pipe 103 is arranged as the inclined surface structure, which can reduce the overall height of the body 300".

In a specific solution, an accommodating groove 303" for allowing the coil fixing bracket 106 of the electronic expansion valve 100 to be embedded therein is provided between the valve-body plane portion 321" of each of the first accommodating positions 302*a*" and the respective first recess portion 311*a*"; and another accommodating groove 303" for allowing the coil fixing bracket 106 of the electronic expansion valve 100 to be embedded therein is also provided between the valve-body plane portion 321" of each of the second accommodating positions 302*b*" and the respective second recess portion 311*b*".

Thus, after the electronic expansion valves 100 are placed, the coil fixing brackets 106 are embedded in the accommodating grooves 303", which can prevent the electronic expansion valves 100 from moving in the body 300', thereby improving the reliability and stability of the package.

In a specific solution, the body 300" may be a pulp molded product or a blister plate product. As shown in the figure, in the specific setting, a supporting table 304" is provided in the middle of the body 300". After packaging, after the bodies 300" are stacked, the supporting tables 304" can play a certain supporting role to improve the overall strength of the bodies 300"; more specifically, multiple supporting pillars 305" may also be provided at both sides of the supporting table 304", to further enhance the load bearing capacity of the bodies 300".

In actual setting, the supporting pillars 305" at both sides of the supporting table 304" can be asymmetrically designed. When the bodies 300" are stacked, the sides of the adjacent two bodies 300" are oppositely provided, that is, when one body 300" is to be stacked, this body 300" is horizontally rotated by 180 degrees with respect to the adjacent body 300", so that the positions of the supporting pillars 305" of the adjacent two bodies 300" do not correspond, which is equivalent to add supporting points and has a very good supporting effect.

Similar to the above second embodiment, the opposite two sidewalls of the body 300" may be both provided with asymmetrically arranged recessed steps 306". Similarly, the packaging structure in this embodiment may also be provided with the structures, such as a cover plate, a protective film and so on, which are not described here.

It should be noted that the above embodiments have been described by taking a specific electronic expansion valve structure as an example, however, all the embodiments described in the present application are not limited to a specific type of electronic expansion valves. Those skilled in the art will appreciate that all types of electric valves having similar appearance configurations can employ the packaging structure provided according to the present application as long as they are provided with a magnetic rotor therein and have a factory-set opening degree requirement. That is, the electronic expansion valve described in the present specification is a broad concept, and the embodiment described in the present specification mainly describes the packaging structure, and it cannot exhaustively list all the internal structures of the electronic expansion valves and it certainly does not need to exhaustively list all the internal structures of the electronic expansion valves.

A packaging structure for an electronic expansion valve provided according to the present application is described in detail. The principle and the embodiments of the present application are illustrated herein by specific examples. The above description of examples is only intended to help the understanding of the method and the spirit of the present application. It should be noted that, for the person skilled in the art, a few of modifications and improvements may be made to the present application without departing from the principle of the present application, and these modifications and improvements are also deemed to fall into the scope of protection of the present application defined by the claims.

The invention claimed is:

1. A packaging structure for electronic expansion valves, comprising: a body for accommodating the electronic expansion valves, wherein the body comprises more than one supporting portion, each supporting portion has first recess portions and second recess portions alternately arranged, the first recess portions and the second recess portions are all configured to support housings of the electronic expansion valves;

two sides of each supporting portion are respectively provided with a first accommodating portion and a second accommodating portion, the first accommodating portion is provided with a plurality of first accommodating positions corresponding to positions of the first recess portions respectively, and the second accommodating portion is provided with a plurality of second accommodating positions corresponding to positions of the second recess portions respectively; and the first accommodating positions and the second accommodating positions are each configured to accommodate a valve body, a first connecting pipe and a second connecting pipe of a respective electronic expansion valve.

2. The packaging structure according to claim 1, wherein the first accommodating positions and the second accommodating positions each comprises a valve-body accommodating portion for accommodating the valve body, a first-connecting-pipe accommodating portion for accommodating the first connecting pipe, and a second-connecting-pipe accommodating portion for accommodating the second connecting pipe; and wherein the first-connecting-pipe accommodating portion is of a stepped structure comprising a high step surface toward the valve-body accommodating portion and a low step surface away from the valve-body accommodating portion; and the second-connecting-pipe accommodating portion is of an inclined surface structure.

3. The packaging structure according to claim 2, wherein an accommodating groove for allowing a coil fixing bracket of a respective electronic expansion valve to be embedded therein is provided between the valve-body accommodating portion of each of the first accommodating positions and the respective first recess portion; and another accommodating groove for allowing a coil fixing bracket of a respective electronic expansion valve to be embedded therein is also provided between the valve-body accommodating portion of each of the second accommodating positions and the respective second recess portion.

4. The packaging structure according to claim 3, wherein each of the accommodating grooves is provided with an arc-shaped groove section fitting with an outer periphery of the coil fixing bracket.

5. The packaging structure according to claim 2, wherein the first connecting pipe is a vertical connecting pipe coaxial with the valve body, the second connecting pipe is a bent pipe provided at a side of the valve body, and the second connecting pipe comprises a transverse pipe section and a vertical pipe section; and the first accommodating positions and the second accommodating positions are each respectively provided with a barrier member, to allow the vertical connecting pipe and the vertical pipe section to be respectively located at two sides of the barrier member after the electronic expansion valve is placed.

6. The packaging structure according to claim 1, wherein a side, away from the supporting portion, of each of the first accommodating positions and the second accommodating positions is provided with a stopping portion for abutting against the first connecting pipe.

7. The packaging structure according to claim 1, wherein the first accommodating positions and the second accommodating positions each comprises a valve-body plane portion for supporting the valve body, a connecting-pipe plane portion for supporting the first connecting pipe, and a connecting-pipe inclined surface portion for supporting the second connecting pipe.

8. The packaging structure according to claim 7, wherein an accommodating groove for allowing a coil fixing bracket of a respective electronic expansion valve to be embedded therein is provided between the valve-body plane portion of each of the first accommodating positions and the respective first recess portion; and another accommodating groove for allowing a coil fixing bracket of a respective electronic expansion valve to be embedded therein is also provided between the valve-body plane portion of each of the second accommodating positions and the respective second recess portion.

9. The packaging structure according to claim 1, wherein opposite two sidewalls of the body are both provided with recessed steps, and the recessed steps on the two sidewalls are asymmetrically arranged.

10. The packaging structure according to claim 1, wherein the body is a blister plate product.

11. The packaging structure according to claim 2, wherein a side, away from the supporting portion, of each of the first accommodating positions and the second accommodating positions is provided with a stopping portion for abutting against the first connecting pipe.

12. The packaging structure according to claim 3, wherein a side, away from the supporting portion, of each of the first accommodating positions and the second accommodating positions is provided with a stopping portion for abutting against the first connecting pipe.

13. The packaging structure according to claim 5, wherein a side, away from the supporting portion, of each of the first accommodating positions and the second accommodating positions is provided with a stopping portion for abutting against the first connecting pipe.

* * * * *